US006164249A

United States Patent [19]

Honold et al.

[11] Patent Number: 6,164,249

[45] Date of Patent: Dec. 26, 2000

[54] PISTON FOR AN INTERNAL COMBUSTION ENGINE

[75] Inventors: Martin Honold, Metzingen; Erwin Schmidt, Baltmannsweller; Siegfried Sumser, Stuttgart, all of Germany

[73] Assignee: Daimler Chrysler AG, Stuttgart, Germany

[21] Appl. No.: 09/267,417

[22] Filed: Mar. 12, 1999

[30] Foreign Application Priority Data

Mar. 13, 1998 [DE] Germany ..... 198 10 937

[51] Int. Cl.[7] ..... F01P 1/04

[52] U.S. Cl. ..... 123/41.35

[58] Field of Search ..... 123/41.35

[56] References Cited

FOREIGN PATENT DOCUMENTS

| | | | |
|---|---|---|---|
| 493 126 | 12/1936 | Belgium . | |
| 2 323 022 | 4/1977 | France . | |
| 1 751 342 | 6/1970 | Germany . | |
| 17 51 342 | 6/1970 | Germany . | |
| 29 21 889 | 12/1980 | Germany . | |
| 1353913 | 11/1987 | U.S.S.R. | 123/41.35 |
| 1578375 | 7/1990 | U.S.S.R. | 123/41.35 |
| 1 041 896 | 9/1966 | United Kingdom . | |

*Primary Examiner*—Willis R. Wolfe
*Assistant Examiner*—Katrina B. Harris
*Attorney, Agent, or Firm*—Klaus J. Bach

[57] ABSTRACT

In a piston for an internal combustion engine, which includes in its top an annular cooling oil passage which, at one side of the piston, is in communication with a cooling oil supply passage extending axially through the piston and has a bottom opening through which cooling oil is supplied by an injection nozzle, and, opposite the cooling oil supply passage, a cooling oil return passage in communication with the annular cooling oil passage for removing the cooling oil therefrom, at least the cooling oil supply passage includes cooling oil retaining pockets which retain, during outward movement of the piston, part of the cooling oil supplied to the cooling oil supply passage and from which the retained cooling oil is dislodged and moved to the annular cooling oil passage during inward movement of the piston.

6 Claims, 1 Drawing Sheet

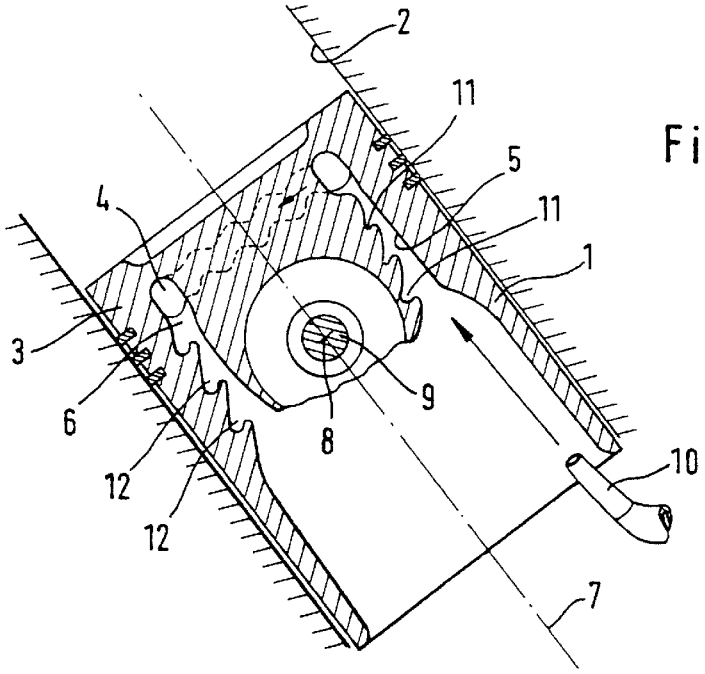
Fig. 1
Fig. 2
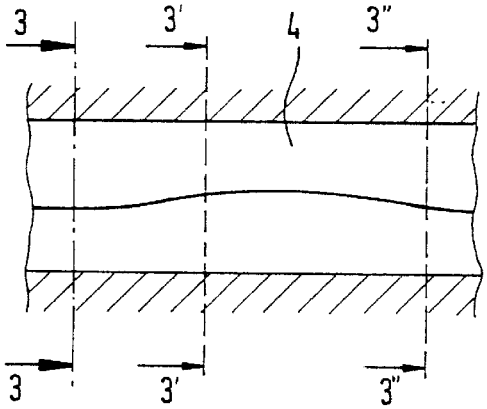
Fig. 3
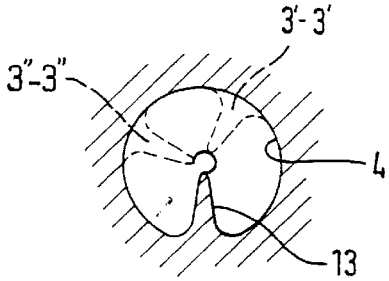
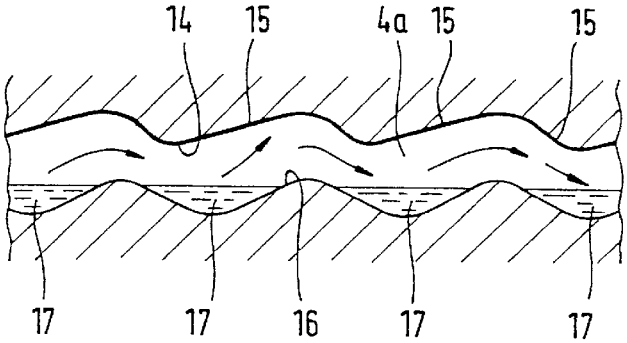
Fig. 4

PISTON FOR AN INTERNAL COMBUSTION ENGINE

BACKGROUND OF THE INVENTION

The invention relates to a piston for an internal combustion engine with an annular cooling oil passage formed in the piston adjacent its top, an oil supply passage extending in the piston essentially parallel to the piston axis and an oil return passage arranged in the piston opposite the oil supply passage.

Such a piston is disclosed, for example, in DAS 1 751 342.

It is the object of the present invention to provide such a piston, which, however, has an increased effectiveness.

SUMMARY OF THE INVENTION

In a piston for an internal combustion engine, which includes in its top an annular cooling oil passage which, at one side of the piston, is in communication with a cooling oil supply passage extending axially through the piston and has a bottom opening through which cooling oil is supplied by an injection nozzle, and, opposite the cooling oil supply passage, a cooling oil return passage in communication with the annular cooling oil passage for removing the cooling oil therefrom, at least the cooling oil supply passage includes cooling oil retaining pockets which retain, during outward movement of the piston, part of the cooling oil supplied to the cooling oil supply passage and from which the retained cooling oil is dislodged and moved to the annular cooling oil passage during inward movement of the piston.

With the arrangement according to the invention, a part of the cooling oil introduced by the oil injection nozzle during upward movement of the piston is retained in the oil pockets formed in the oil passages and, because of its increased residence time, can remove a greater amount of heat from the piston. During the return movement of the piston, the oil that had been retained in the pockets is thrown into the annular cooling passage together with the oil injected by the oil injection nozzle. Since the transport of the cooling oil to the annular cooling oil passage is supported by the return movement of the piston the power of the oil supply pump for oil injection nozzle may be relatively low.

If the cylinder axis is inclined, it is particularly advantageous if the oil supply passage is disposed above and the return passages is disposed below the longitudinal center axis of the piston. Then, the transport of the cooling oil through the annular passages is supported by gravity, not impeded by the gravity forces as in DAS 1 751 342.

Preferably, several oil-retaining pockets are arranged along the lower inner side of the oil supply passage. Corresponding retaining pockets may also be arranged along the wall of the oil return passage.

In order to improve heat removal from the cylinder head, the annular cooling passage may be provided with a spiraled wall, which imparts rotational turbulent component to the movement of the cooling oil flowing through the annular cooling passage. This increases the cooling oil flow length and also the residence time of the cooling oil thereby increasing heat removal from the piston. In addition, the annular cooling passage may be provided at its top side with inclined ramps and, at the lower side, it may have troughs displaced from the ramps in circumferential direction. Then, as a result of the back and forth movement of the piston, the cooling oil is on one hand moved circumferentially through the annular cooling oil passage and, on the other hand, retained in the troughs whereby its residence time in the annular passage is increased.

The invention will be described in greater detail below on the basis of the accompanying drawings.

BRIEF DESCRIPTION OF THE DRAWINGS

FIG. 1 is an axial cross-sectional view of a piston in a cylinder of a V-type internal combustion engine in which the cylinders or inclined, FIG. 2 shows a partial development of the annular cooling passage in the piston head, FIG. 3 is a cross-sectional view taken along lines 3—3 FIG. 2, and FIG. 4 shows a development of an annular cooling passage part.

DESCRIPTION OF A PREFERRED EMBODIMENTS

FIG. 1 shows a piston 1 disposed in a cylinder 2 of V-type internal combustion engine in which the cylinders are inclined. The piston 1 includes a head portion 3 with an annular cooling oil passage 4, which is in communication with an cooling oil supply passage 5 and a cooling oil return passage 6. The passages 5 and 6 extend essentially parallel to the piston axis 7 and are arranged diametrically opposite each other in a plane extending normal to the axis 8 and through the axial center of the piston pin 9.

The cooling oil is supplied to the oil supply passage 5 by a stationary injection nozzle 10 and then flows through the annular cooling oil passage 4, which it leaves through the oil return passage 6.

As shown in FIG. 1, the oil supply passage 5 is disposed above the longitudinal center axis 7 of the piston 1 and the oil return passage 6 is disposed below. In this way, the flow of cooling oil through the annular passages 4 is supported by gravity.

Along the lower inside wall of the supply passage 5 several oil retaining pockets 11 are arranged, one after the other, in such a way that they retain part of the oil supplied by the injection nozzle 10, when the piston moves outwardly that is toward its top dead center position. During the following inward return movement of the piston the oil retained in the pockets leaves the pocket and is thrown, together with the oil from the injection nozzle 10, into the annular cooling oil passage 4. In a similar way, the lower side of the oil return passage 6 may be provided with oil retaining pockets 12.

In order to increase the residence time of the cooling oil in the annular cooling oil passage 4, the annular cooling oil passage 4 may be provided with a spiral wall structure 13. The course of the spiral wall structure 13 is shown schematically in FIG. 3 by the cross-sections 3'–3' and 3"–3" given in dashed lines.

Instead of a spiral wall structure, or in addition thereto, the annular cooling oil passage in the cylinder head may also have the shape as shown in FIG. 4. In this case, the cooling oil passage 4a includes at its upper inner walls 14 inclined portions forming ramps 15 and, at its lower inner walls 16, troughs 17, which are displaced from the ramps 15 in circumferential direction. During return movement of the piston, the oil is thrown out of the troughs 17 against the ramp 15, whereby it is moved forwardly. Then, during the following outward movement of the piston 3, the oil is directed into the next downstream trough 17 as indicated by the arrows. In this way, a strong heat transfer is provided which is intensified by the increased residence time of the cooling oil in the troughs 17.

What is claimed is:

1. A piston for an internal combustion engine including a piston top having an annular cooling oil passage formed therein, a cooling oil supply passage extending at one side of said piston essentially parallel to the axis of said piston and being in communication with said annular cooling oil passage at one side of said piston and a cooling oil return passage extending at the opposite side of said piston essentially parallel to the axis of said piston and being in communication with said annular cooling passage at the opposite side of said piston, said cooling oil supply passage including cooling oil retaining pockets so shaped that they retain during outward movement of said piston part of the cooling oil supplied to said supply passage from a cooling oil supply nozzle directing oil into said oil supply passage and upon reversal of the outward movement of the piston, discharge the oil retained in said pockets toward said annular cooling oil passage formed in the piston top.

2. A piston according to claim 1, wherein, for disposition in an inclined cylinder, said cooling oil supply passage is disposed above the axis of said piston and said cooling oil return passage is disposed below said piston axis and, upon reversal of the outward movement of the piston, discharged the oil retained in said pockets toward said annular cooling oil passage formed in the piston top.

3. A piston according to claim 2, wherein said oil supply passage includes several oil retaining pockets arranged one after the other in the walls of said cooling oil supply passage at the inner lower side of the passage.

4. A piston according to claim 2, wherein several oil retaining pockets are arranged, one after the other, in the wall of the cooling oil return passage at the lower side thereof remote from the piston axis.

5. A piston according to claim 1, wherein said annular cooling oil passage is provided with a spiral wall structure imparting a rotational motion to the cooling oil flowing through the annular cooling oil passage.

6. A piston according to claim 1, wherein said annular cooling oil passage has, in the direction of movement of said piston, opposite upper and lower passage walls and the upper passage walls are provided with inclined ramps and the lower passage walls are provided with troughs which are displaced from the ramps in circumferential direction of said annular cooling oil passage.

* * * * *